United States Patent [19]

Antonis

[11] 4,278,908

[45] Jul. 14, 1981

[54] HEATING OF DOSING CAPSULE

[75] Inventor: Basil Antonis, London, England

[73] Assignee: Thorn Electrical Industries Limited, London, England

[21] Appl. No.: 22,443

[22] Filed: Mar. 21, 1979

[30] Foreign Application Priority Data

Mar. 31, 1978 [GB] United Kingdom ..... 12748/78

[51] Int. Cl.[3] ..... H01J 61/28

[52] U.S. Cl. ..... 313/177

[58] Field of Search ..... 313/177, 174

[56] References Cited

U.S. PATENT DOCUMENTS

| | | | |
|---|---|---|---|
| 1,996,506 | 4/1935 | Eitel | 313/177 |
| 2,188,186 | 1/1940 | Kling | 313/177 |
| 3,764,842 | 10/1973 | Ridders et al. | 313/177 |
| 3,794,403 | 2/1974 | Ridders et al. | 313/177 X |
| 4,056,750 | 11/1977 | Latassa | 313/177 |

*Primary Examiner*—Robert Segal

*Attorney, Agent, or Firm*—Robert F. O'Connell

[57] ABSTRACT

In a method of dosing a gas discharge lamp by opening a dosing capsule by the heating action of an electromagnetic field on a metallic support, the support is in the form of a sheet metal clip embracing the capsule and having an opening through which the softened glass of the capsule is forced by the internal pressure. Breakage of the capsule is eliminated and the glass forced through the opening ensures retention of the capsule by the clip. The clip is preferably of ferromagnetic material.

9 Claims, 2 Drawing Figures

HEATING OF DOSING CAPSULE

The present invention relates to a method of introducing a dosing material into a gas discharge lamp from a glass capsule mounted in a metallic support within the envelope of the lamp by using an electromagnetic field to heat the support and thereby open the capsule.

A method of this kind, in which the dosing material is mercury, is described in U.S. Pat. No. 2,415,895. In that specification the glass capsule is held within a metal casing closed by a metal gauze. When the casing is heated the capsule cracks and releases the dosing material, this cracking being encouraged by marking of the glass with a diamond cutter. The gauze ensures that the parts of the glass capsule are retained within the casing. Such an arrangement requires an elaborate series of manufacturing steps for the capsule and its support which are difficult to carry out on the small scale necessary for incorporation in a discharge lamp such as a fluorescent tube. The additional expense involved in the formation of the casing, the marking of the capsule, and the securing of the metal gauze cover to the capsule is not acceptable for large scale production of such lamps. Moreover the behaviour of the capsule when radio frequency heating is applied to the casing is not predictable and there is a danger of tiny droplets of mercury being ejected with considerable force in various directions.

In accordance with the present invention these difficulties are overcome in that the metallic support comprises a sheet metal clip fitting closely about the capsule and having an opening through which the glass of the capsule is forced by the pressure within the capsule when the sheet metal surrounding the opening is heated by the electromagnetic field and thereby softens the glass.

The sheet metal clip for supporting the capsule is much simpler to manufacture. The puncturing of the capsule at the opening and the resultant "blowing out" of the glass causes it to grip the sheet metal surrounding the opening and thereby hold the capsule firmly in position during operation of the lamp.

When the dosing material is mercury the capsule is preferably longer than the clip so that the ends of the capsule provide cooler reservoirs for the mercury, thus reducing the risk of violent ejection of droplets of mercury.

The invention will now be described in more detail with the aid of an example illustrated in the accompanying drawing, in which.

Figure 1:
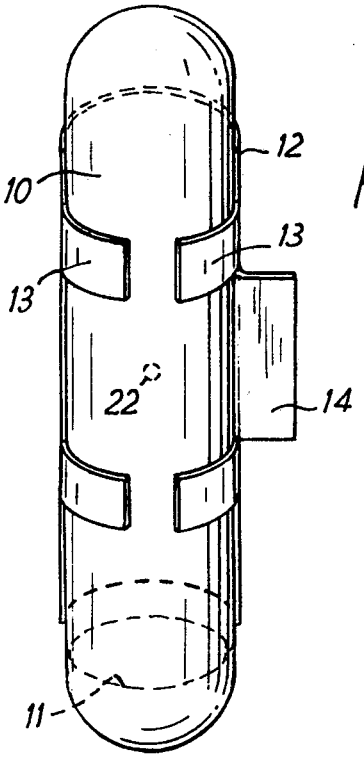
FIG. 1 is a perspective view of a capsule held in a metal clip.

As shown in FIG. 1 a capsule 10 containing of body 11 of mercury or other dosing material is held in a sheet metal clip 12. The capsule 10 is of low melting point lead glass and has a cylindrical tubular form with domed ends. The clip 12 is made of a ferromagnetic material such as iron or mild steel and comprises a half cylinder dimensioned to fit closely around the capsule with two pairs of tabs 13 extending from the edges to embrace the capsule and a tag 14 bent outward from one edge to enable the clip to be mounted in the lamp. Typically the capsule is 10–15 mm long with a diameter of 2 mm and the clip is 7 mm long. This leaves the ends of the capsule free of the clip and thereby keeps them cooler.

Figure 2:
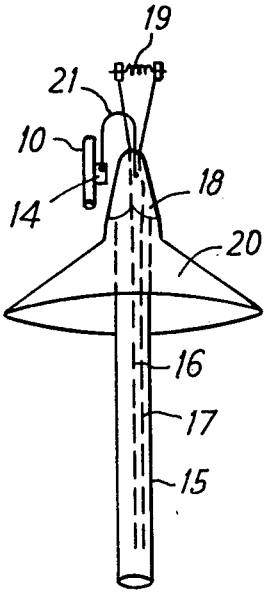
FIG. 2 is a side view of an end assembly for the manufacture of a fluorescent tube incorporating the clip and capsule of FIG. 1.

As shown in FIG. 2 a conventional end assembly for a fluorescent lamp comprises a tube 15, leads 16 and 17 passing through the tube and through a pinch 18 at one end of the tube, a filament 19 mounted on the leads 16 and 17, and a flared skirt 20 depending from the pinch 18 and intended for attachment at its periphery to one end of the tubular lamp envelope. The end assembly differs from the conventional arrangement only in the provision of a third wire 21 embedded in the pinch 18 and welded to the tag 14 of the metal clip 12 to support the capsule 10.

After assembly of the lamp by conventional methods the body 11 of mercury is released from the capsule 10 by heating the clip 12 by means of an induction coil disposed around the end of the tubular lamp envelope. A coil of two or three turns large enough to fit around a tube of 40 mm diameter and carrying a high frequency alternating current is sufficient to generate the required heat in the ferromagnetic material of the clip 12. The heat is generated primarily by magnetic loss in the material and consequently precise positioning of the coil with respect to the clip is not required.

Near the centre of the clip 12 there is a hole 22 (see FIG. 1). When the clip is heated the glass of the capsule wall is softened where it is in contact with the clip and the internal pressure developed in the capsule is sufficient to perforate the wall of the capsule at the edge of the hole 22. The mercury dose then escapes from the capsule into the envelope of the lamp. The melting of the glass of the capsule causes it to deform around the edge of the hole and thus secures the capsule firmly to the clip so that it cannot fall away during subsequent use of the lamp. Preferably the hole 22 in the clip is directed towards the pinch 18 when the clip is mounted in the lamp. This is to minimize the risk of droplets of mercury striking the fluorescent phosphor coating on the inner surface of the lamp envelope.

A suitable size for the hole 22 is a circular hole with a diameter of 1 mm.

Although the introduction of mercury has been specifically referred to, it will be appreciated that the invention can be used to introduce any dosing material, whether this be a solid, a liquid or a gas, or a mixture of any of these.

I claim:

1. In a method of introducing a dosing material into a gas discharge lamp from a glass capsule mounted in a metallic support within the envelope of the lamp by using an electromagnetic field to heat the support and thereby open the capsule, the improvement which comprises constructing the metallic support as a sheet metal clip having an opening therethrough, fitting the clip closely about the capsule, and heating the sheet metal of the clip around the said opening by means of the electromagnetic field, thereby softening the glass and causing the softened glass to be forced through the opening by the pressure developed within the capsule.

2. In the method of claim 1 the further improvements comprising forming the capsule in a cylindrical shape, constructing the clip with a part-cylindrical portion in which the opening is formed and tabs extending from the edges of the part-cylindrical portion, placing the cylindrical capsule in the part-cylindrical portion of the clip and wrapping the tabs around the capsule.

3. In the method of claim 2 the further improvement of making the clip of such a length that the ends of the capsule extend beyond the clip to provide a cooler region at the said ends.

4. In the method of any of claims 1 to 3 the further improvement of forming the clip from ferromagnetic material.

5. In a method of introducing a dosing material into the envelope of a gas discharge lamp, the method comprising the steps of:

depositing the dosing material in a glass capsule and closing the capsule, mounting the capsule within the envelope by means of a metallic mounting member and exposing said member to electromagnetic radiation to cause heating thereof, so that the capsule is opened and the dosing material is released, the improvement comprising inserting said capsule into a metallic mounting member formed as a sheet metal clip member so that the clip member partially surrounds the capsule over a part at least of the capsule's length, mounting the capsule inside the envelope by means including the clip member and closing said envelope, applying said electromagnetic radiation to the metal clip member to soften glass of the capsule and to permit glass from the capsule to be forced by pressure within the capsule through a hole formed in the sheet metal of the clip member, thus opening the capsule, to achieve the introduction of said dosing material and also anchoring the capsule firmly to the clip member.

6. An arrangement suitable for introducing a dosing material into the envelope of a gas discharge lamp, the arrangement including a sealed glass capsule accommodating the dosing material and a metallic support member which, when enclosed within the envelope and exposed to electromagnetic radiation, heats the capsule and causes it to rupture thereby releasing the dosing material, wherein the metallic support member includes a portion adapted to fit closely about said capsule and an aperture, in said portion, through which the wall of the capsule is exposed and through which glass softened by heating the support member by said electromagnetic radiation can issue, thereby opening the capsule to release the dosing material.

7. An arrangement as claimed in claim 6 in which the capsule is of cylindrical shape and the support member comprises a part-cylindrical portion in which said aperture is formed and a plurality of tabs extending from the edges of the part-cylindrical portion to embrace the capsule.

8. An arrangement as claimed in claim 7 in which the ends of the capsule extend beyond the support member to provide a cooler region at the ends of the capsule.

9. An arrangement as claimed in any one of claims 6 to 8 in which at least the part-cylindrical portion of the support member is ferro-magnetic.

* * * * *